US006288377B1

(12) United States Patent
Wu et al.

(10) Patent No.: US 6,288,377 B1
(45) Date of Patent: Sep. 11, 2001

(54) VARNISH OVEN FOR MANUFACTURING PROCESS

(75) Inventors: Zili Wu, Saline; David Arthur Nelson, Canton; Robert Steven Gruden, Dundee, all of MI (US); Joel Alex Shingledecker, Racine, WI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/401,440

(22) Filed: Sep. 22, 1999

(51) Int. Cl.[7] ..... H05B 6/16

(52) U.S. Cl. ..... 219/656; 118/66; 34/272; 34/381

(58) Field of Search ..... 219/656, 655, 219/609, 653, 635, 388; 118/66, 666, 58, 641–643, 69, 407, 322, 679, 64, 719; 34/270–272, 266, 247, 381, 210, 218; 427/8

(56) References Cited

U.S. PATENT DOCUMENTS

| | | | | |
|---|---|---|---|---|
| 3,028,266 | | 4/1962 | Larsh . | |
| 3,965,852 | * | 6/1976 | Hardy | 118/679 |
| 4,224,355 | * | 9/1980 | Lampkin et al. | 427/8 |
| 4,336,443 | | 6/1982 | Benedetto . | |
| 4,792,462 | | 12/1988 | Smith et al. . | |
| 4,805,551 | * | 2/1989 | Marazzi | 118/64 |
| 5,193,735 | * | 3/1993 | Knight | 228/42 |
| 5,273,585 | * | 12/1993 | Shoga et al. | 118/719 |
| 5,389,152 | | 2/1995 | Thurston et al. . | |
| 5,474,799 | | 12/1995 | Thigpen et al. . | |
| 5,770,835 | * | 6/1998 | Sakuyama et al. | 219/388 |
| 5,847,370 | * | 12/1998 | Sluka et al. | 219/635 |
| 5,937,535 | * | 8/1999 | Hoffman, Jr. et al. | 34/78 |
| 6,024,795 | * | 2/2000 | Galassi et al. | 118/322 |

* cited by examiner

*Primary Examiner*—Teresa Walberg
*Assistant Examiner*—Quang Van
(74) *Attorney, Agent, or Firm*—Jerome Drouillard

(57) ABSTRACT

A varnish oven (10), including a preheating station (12), a temperature homogenization station (14), a varnish application station (16), a varnish curing station (18), a cooling station (20), a conveyor system (24) and a control system (38). The conveyor system (24) moves parts through the oven. The parts start at the preheating station (12) where portions of the part are raised to an appropriate temperature for varnish application. The parts then move to the temperature homogenization station (14) where the temperature is maintained at an appropriate level. Varnish is applied to the part in the varnish application station (16) and is cured in the varnish curing station (18). Finally the part is cooled in the cooling station (20). The control system (38) varies the temperature of the preheating station (12), the temperature homogenization station (14), and the cooling station (20) to maintain part temperature upon stoppage of the conveyor system (24).

19 Claims, 3 Drawing Sheets

VARNISH OVEN FOR MANUFACTURING PROCESS

TECHNICAL FIELD

The present invention relates generally to a varnishing oven. More particularly, the present invention relates to a varnishing oven design for a fan rotor manufacturing process.

BACKGROUND ART

Varnish is applied to automotive parts for a variety of well known purposes, such as improving part appearance, durability and performance. Although the primary purpose of a varnish coating is often for protection, varnish can also be used for noise reduction purposes, such as when used on various parts, including as fan rotors.

A variety of oven devices have been developed for applying varnish to parts and particularly to automotive parts. Conventional oven devices typically require the following steps: heating the part in an oven, applying varnish to the part, post baking the varnished part, curing the varnish, and cooling the part. The oven is often required to heat the part to a high temperature for extended periods of time in order for the varnish to be properly applied.

For example, for automotive parts, conventional varnish ovens typically take 15–20 minutes to heat the part to the desired temperature range for varnish application. This extended period of time is required to adequately heat the automotive part thoroughly to its core. If an automotive part is not heated adequately to its core, the temperature of the automotive part's surface will drop rapidly when removed from the temperature source. Any drop in surface temperature of the automotive part can result in unacceptable application or curing of the varnish. Heating the automotive part down to its core further requires extended preheating time.

This extended preheat time is undesirable since it requires additional energy and adds to the part processing time thus increasing the cost to manufacture each part. To compensate for this extended baking period, conventional designs increase the size of the oven in order to process larger numbers of parts at once. This increases productivity, but does so at the expense of oven size and energy costs.

Conventional oven size and cost is further increased by the use of post bake procedures. These procedures require further baking of the automotive part after the varnish has been applied. The varnished part is further baked to ensure that the varnish is adequately cured before the part is cooled. The additional heating further increases the cost, production time, and size of conventional varnish ovens.

It would therefore be advantageous to have a varnish oven that reduces the time and energy required to preheat, apply varnish and cure the varnish on the parts, reduces the size and cost of the oven, and reduces the cost to manufacture each part.

SUMMARY OF THE INVENTION

It is therefore an object of the present invention to provide a varnish oven for use in a manufacturing process that minimizes the time required for an associated curing process. It is a further object of the present invention to provide a varnish oven for use in manufacturing processes that reduces the overall time required to process a part. It is a further object of the present invention to provide a varnish oven for use in the manufacturing process that reduces oven size, reduces oven cost and increases oven energy savings.

In accordance with the objects of the present invention, an improved varnish oven is provided. The varnish oven includes a preheating station using induction heating to quickly raise the surface temperature of the part and/or resistance heating to quickly raise the temperature of the windings to temperatures suitable for varnishing. The varnish oven includes a temperature homogenization station to ensure that a proper temperature is maintained across the surface of the part prior to the application of varnish. The varnish oven also includes a varnish application station where varnish is applied to the temperature controlled part, a varnish curing station where the varnish is allowed to set, and a cooling station where the part temperature is reduced. The varnish oven further includes an indexing conveyor to move parts through the oven stations and a control system for maintaining part temperature throughout the oven.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
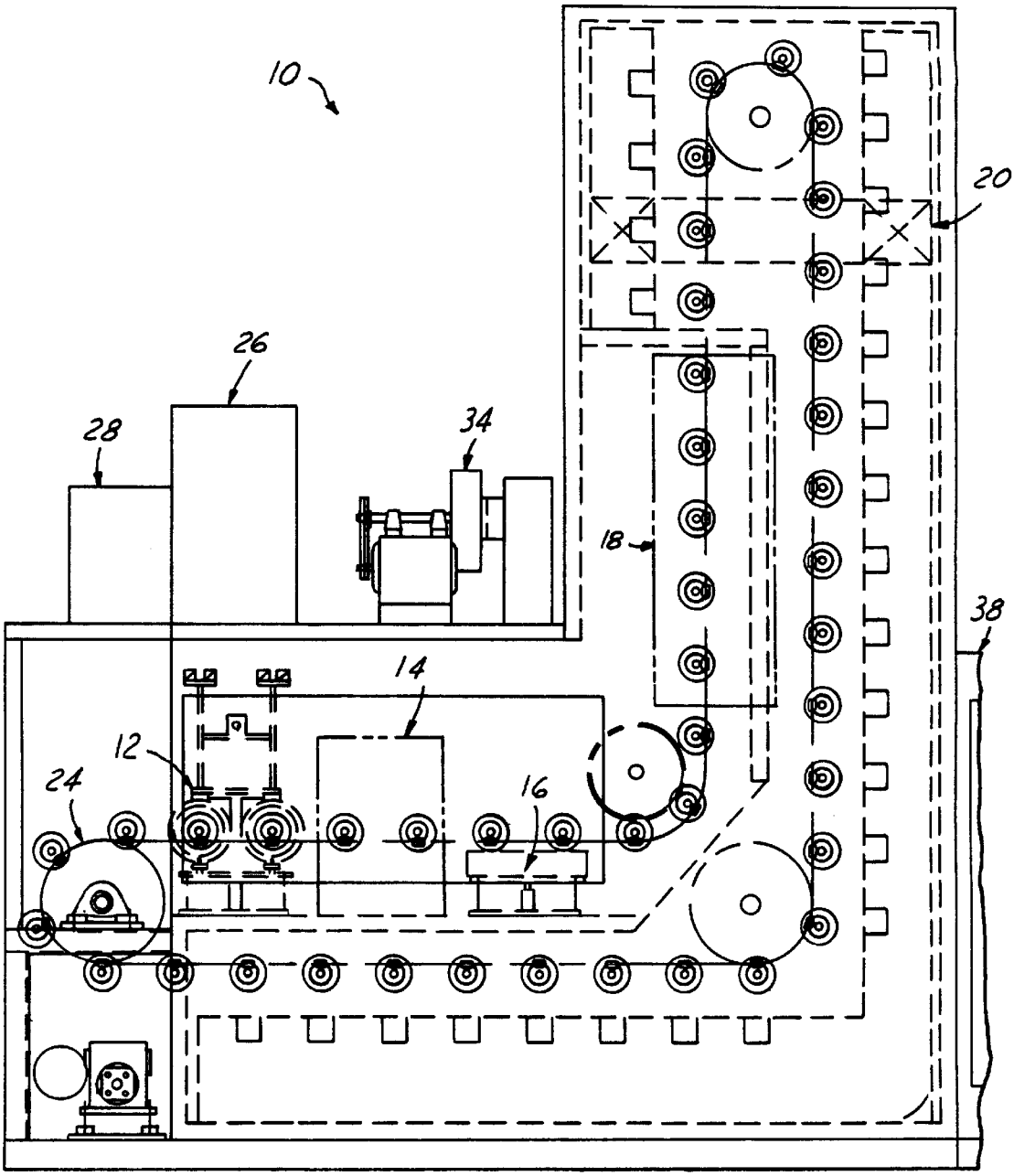
FIG. 1 is a top view of a varnish oven in accordance with the preferred embodiment of the present invention.

FIG. 1 illustrates a preferred embodiment of the present invention. It is to be understood, however, that the present invention is not limited to the structure or configuration of the elements depicted in the drawings and that other structures and configurations can be utilized within the scope and means of the present invention.

Referring now to FIG. 1, which illustrates a varnish oven 10 in accordance with a preferred embodiment of the present invention. The disclosed varnish oven 10 is described in connection with parts for automotive applications, however it should be understood that the preferred varnish oven may be used in a variety of different applications. The preferred embodiment has been configured for the varnishing of fan rotors although the configuration can be used or varied for use with other automotive or non-automotive automotive parts. The varnish oven 10 includes a preheating station 12, a temperature homogenization station 14, a varnish application station 16, a varnish curing station 18, a cooling station 20, and a conveyor system 24 to move the parts through the oven.

The preheating station 12 raises the temperature of the rotors or other parts that pass through the station to a temperature suitable for varnish application. In the preferred embodiment of the invention, the preheating station 12 raises the surface temperature of the rotors or other parts using inductive heating and raises the temperature of the windings of the rotors or other parts using resistance heating. The use of inductive heating, resistance heating, or both may be chosen based upon the construction of the part to which varnish will be applied. Applications such as wiper motor armature varnish may be best suited to resistance preheating. Other applications, such as starter motor armature, may be best suited for induction preheating. Fan rotors are best processed using a combination of preheating methods.

By way of illustration, during a preheating process an induction coil, powered by induction power supply 26, passes over the rotor or other part and heats it for a short time (on the order of 15 seconds). Then an electrical current, powered by resistance power supply 28, is applied to the rotor windings to heat the rotor windings by resistance heating for a similar period of time. The process raises the surface temperature of the rotor or other part to the desired temperature in approximately 30 seconds. It should be understood that these times are only examples and may obviously be varied. By only heating the surface of the rotors or parts and the windings, the present invention raises the temperature suitable for varnish application faster than conventional ovens.

The parts then travel along the conveyor 24 to the temperature homogenization station 14 to prevent any premature cooling. The temperature homogenization station 14 maintains the appropriate surface temperature of the rotor or other part prior to varnish application. When a part leaves the preheating station 12, its surface temperature may begin to drop as heat transfers to the unheated core of the part. The temperature homogenization station 14 compensates for any heat loss the part may sustain. In the preferred embodiment, the temperature homogenization station 14 maintains the appropriate surface temperature through a combination of steps. First the part is rotated on the conveyor system 24 and a radiant heater control panel is used to control temperature. The rotation of the part ensures that the entire surface area of the rotor or other part will be exposed to the radiant heater panel. The part does not need to be symmetrical in shape, such as a fan rotor, to benefit from this rotation. The temperature of the radiant heater panel is varied to ensure the entire surface area maintains an appropriate temperature for varnish application. The part is then moved on the conveyor system 24 to the varnish application station 16. In the preferred embodiment, the part is rotated substantially the entire time it passes throughout the varnish oven 10.

Figure 2:
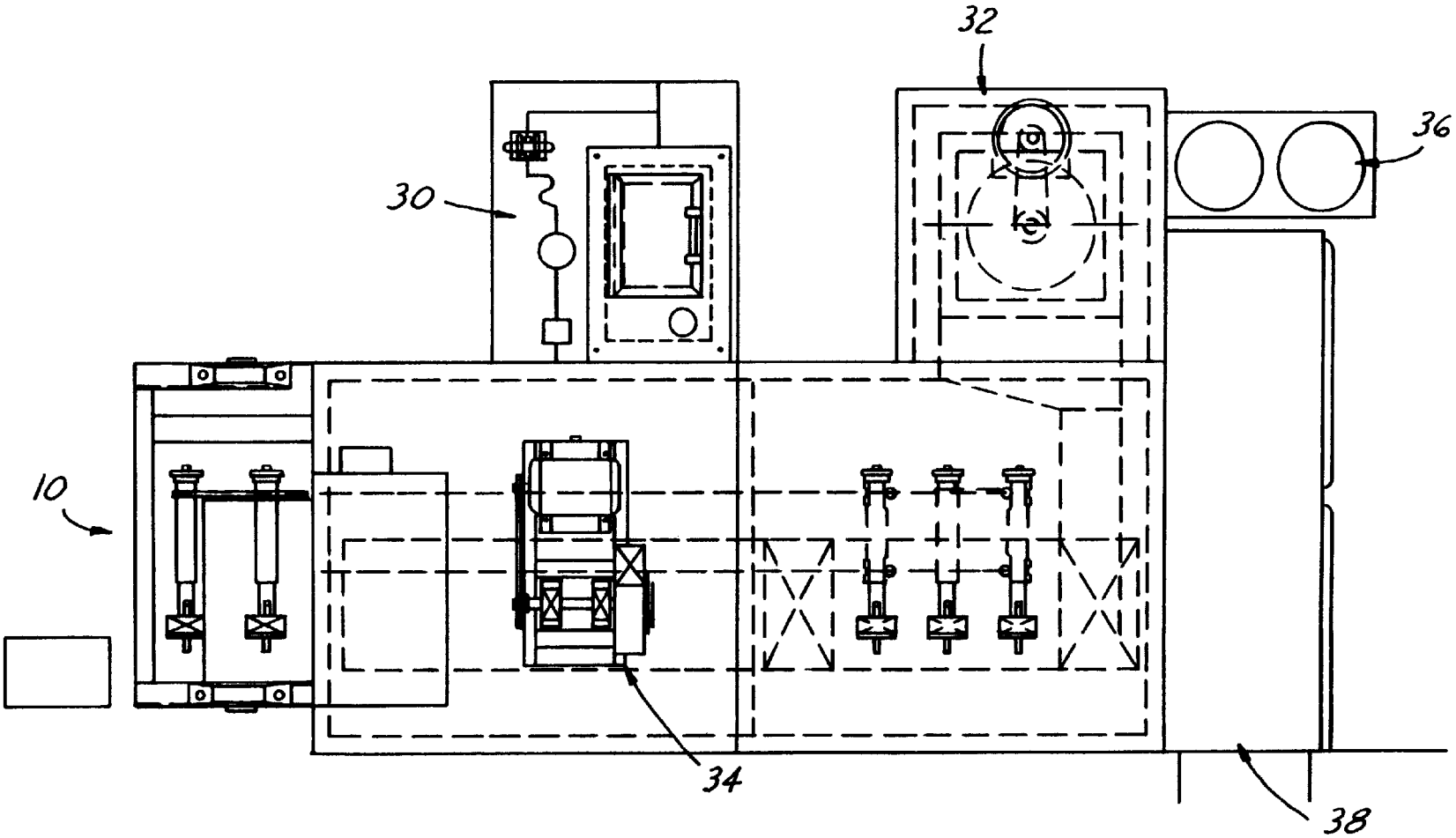
FIG. 2 is a side view of a varnish oven in accordance with the preferred embodiment of the present invention.

The varnish application station 16 applies varnish to the rotor or part. In the preferred embodiment of the invention, the varnish is applied through submersion. A pool of varnish is maintained in the varnish application station 16 and, as the part passes through the station on the conveyor system 24, it is submerged in the pool of varnish. The pool of varnish pool in the varnish application station 16 is maintained by a varnish reservoir and pumping system 30 (best viewed in FIG. 2). Although the preferred embodiment applies varnish by submersion, the varnish may be applied by any number of acceptable conventional methods, such as by spraying. After the varnish is applied, the part is moved by the conveyor system 24 to the varnish curing station 18.

The varnish curing station 18 allows the varnish applied to the rotor or part to cure. In the preferred embodiment, the part cures automatically within about three minutes at ambient temperature. Although conventional ovens often require post bake procedures for curing varnish on parts, such procedures are not required in the present invention. In this respect, although the invention does not require post bake procedures, such procedures may still be used if required by the type of varnish materials utilized. Without a post bake procedure, the cured rotor or part is moved on the conveyor system 24 to the cooling station 20.

The cooling station 20 lowers the temperature of the varnished rotor or part so that it may be readily handled and further processed. In the preferred embodiment of the invention, the cooling station 20 lowers the temperature of the rotor or part through the use of water chilled air with an adjustable flow rate supplied from a cooler recirculation fan 32, although alternate conventional methods of lowering the temperature of parts or materials may be used.

By way of example, with use of the present invention, two fan rotors can be processed every forty seconds for a production rate of 180 parts/hour. Also, that production rate, can be maintained with the use of a relatively a small oven of approximately 5' by 10' (not including accessories such as fire protection and control panels). The present invention contains accessories such as a system exhaust fan 34 and fire suppression cylinders 36 (best viewed in FIG. 2).

Figure 3:
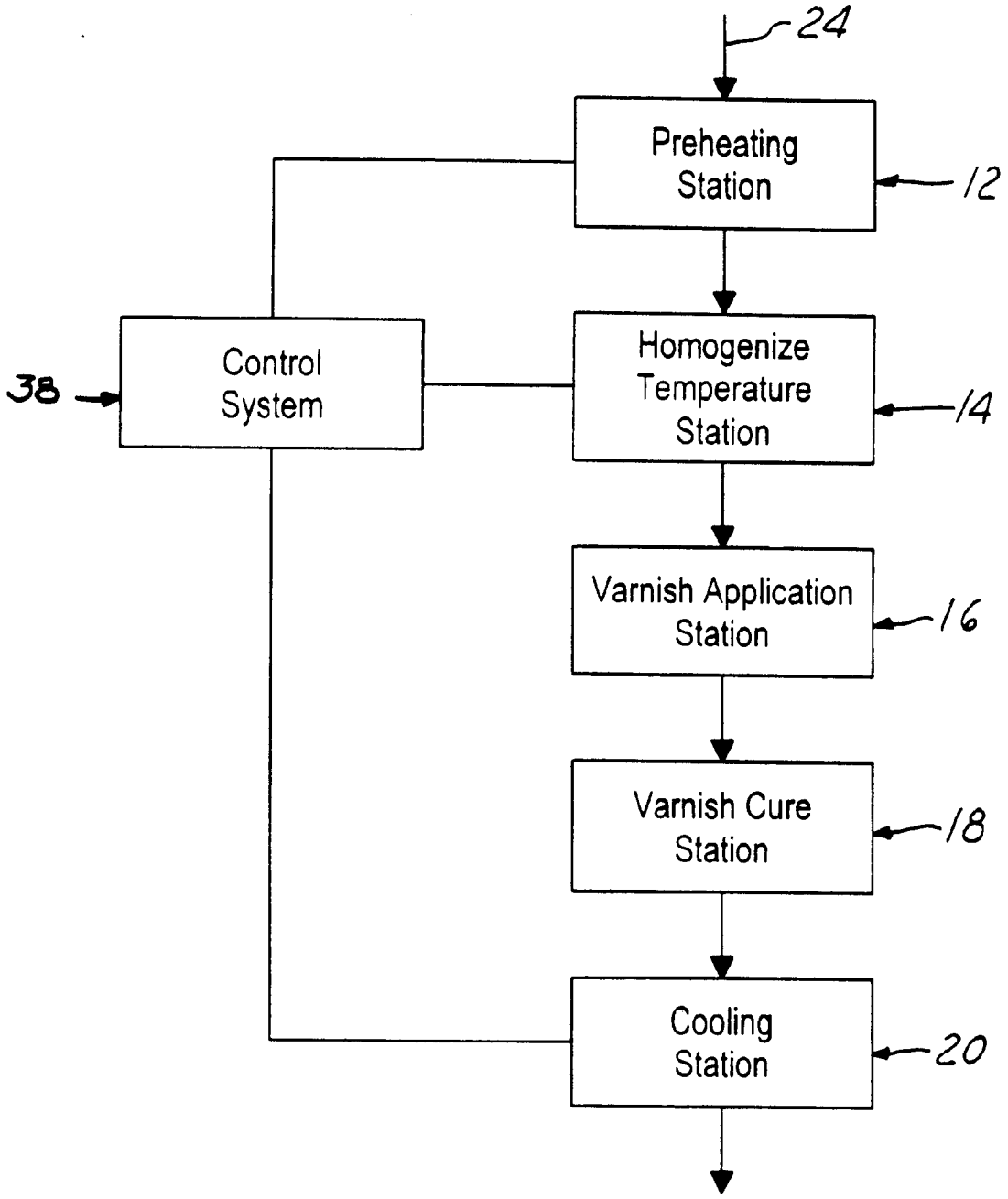
FIG. 3 is a schematic flow chart illustrating the operation of a varnish oven in accordance with the preferred embodiment of the present invention.

The present invention utilizes a control system 38 to maintain the surface temperature of the part or rotor or part at a desired level throughout the varnish oven 10. The control system 38 monitors the surface temperature of the part using infra-red sensors located in the temperature homogenization station and the cooling station. Sensors may be placed at various locations throughout the oven. The control system 38 varies the temperatures of the preheating station 12, homogenization station 14, and cooling station 20 as required to compensate for any temperature increases or decreases in surface temperature of the part that may occur, such as during conveyor idling or stoppage. By this method, proper rotor or part surface temperature is maintained at each station throughout the varnish oven 10. A simplified flow chart of the preferred embodiment is shown in FIG. 3.

The production rate of the present invention can be increased dramatically by the introduction of multiple stations. By simply adding an additional preheating station, an additional temperature homogenization station, an additional station for applying a coat of varnish, an additional station for curing the coat of varnish and an additional cooling station side by side with the stations previously described, the production rate of the present invention doubles while only minimally increasing in size.

While particular embodiments of the invention have been shown and described, numerous variations and alternate embodiments will occur to those skilled in the art. Accordingly, it is intended that the invention be limited only in terms of the appended claims.

What is claimed is:

1. A varnish oven for applying and curing a coat of varnish on at least one part comprising:

at least one preheating station for heating a portion of the at least one part;

at least one temperature homogenization station for maintaining a temperature of said portion of the at least one part;

at least one station for applying a coat of varnish to said portion of the at least one part;

at least one station for curing said coat of varnish on said portion of the at least one part;

at least one station for cooling the at least one part; and a conveyor system for transporting the at least one part through the oven from station to station.

2. A varnish oven as recited in claim 1, wherein said at least one station for applying a coat of varnish comprises a pool of varnish in which the at least one part is submersed.

3. A varnish oven as recited in claim 1, wherein said at least one station for cooling comprises water-chilled air with an adjustable flow rate.

4. A varnish oven as recited in claim 1, further comprising a control system that controls the temperatures of each of said at least one preheating station, said at least one temperature homogenization station, and said at least one cooling station to maintain the at least one part temperature within a predetermined range.

5. A varnish oven as recited in claim 1, wherein said at least one preheating station comprises inductive heat and said portion comprises the surface of the at least one part.

6. A varnish oven as recited in claim 1, wherein said at least one preheating station comprises resistive heat and said portion of the at least one part comprises at least one winding.

7. A varnish oven as recited in claim 1, wherein said at least one preheating station comprises a combination of inductive and resistive heat and said portion of the at least one part comprises said surface and at least one winding.

8. A varnish oven as recited in claim 1, wherein the at least one part is rotated as it travels from station to station within the oven.

9. A varnish oven as recited in claim 1, wherein said at least one temperature homogenization station utilizes a temperature-controlled radiant heater panel.

10. A varnish oven for applying and curing a coat of varnish on at least one part comprising:

at least one preheating station for heating the surface of the part;

at least one temperature homogenization station for maintaining a temperature of said surface of the at least one part;

at least one station for applying a coat of varnish on said surface of the at least one part;

at least one station for curing said coat of varnish on said surface of the at least one part; and a conveyor system for transporting the at least one part through the oven from station to station.

11. A varnish oven as recited in claim 10, wherein said at least on preheating station utilizes inductive heat.

12. A varnish oven as recited in claim 10, further comprising a control system that controls the temperatures of each of said at least one preheating station, and said at least one temperature homogenization station to maintain the at least one part temperature within a predetermined range.

13. A varnish oven as recited in claim 10, wherein the at least one part is rotated as it travels from station to station within the oven.

14. A method of applying and curing a coat of varnish on at least one part comprising the steps of:

preheating at least one portion of the at least one part to a temperature suitable for applying varnish;

maintaining a temperature across said at least one portion of the at least one part;

applying said coat of varnish to the at least one part;

curing said coat of varnish on the at least one part;

cooling the at least one part; and transporting the at least one part to at least one station for said preheating, said maintaining, said applying, said curing, and said cooling steps.

15. A method as recited in claim 14, further comprising the step of rotating the at least one part as it is transported through each of said steps.

16. A method as recited in claim 14, further comprising the step of varying said preheating, said maintaining, and said cooling steps to maintain uniform part temperatures during stoppages.

17. A method as recited in claim 14, wherein said step of preheating at least one portion of the at least one part to a temperature suitable for applying varnish comprises raising the surface temperature of the at least one part using inductive heat.

18. A method as recited in claim 14, wherein said at least one portion of the at least one part includes at least one winding and said step of preheating at least one portion of the at least one part to a temperature suitable for applying varnish comprises raising the temperature of said at least one winding using resistant heat.

19. A method as recited in claim 14, wherein said at least one portion of the at least one part includes at least one winding and said step of preheating at least one portion of the at least one part to a temperature suitable for applying varnish comprises raising the surface temperature of the at least one part using inductive heat and raising the temperature of said at least one winding using resistive heat.

* * * * *